US012708173B2

(12) United States Patent
Lisman

(10) Patent No.: US 12,708,173 B2
(45) Date of Patent: Aug. 18, 2026

(54) ERGONOMIC HIGH HEELED FOOTWEAR

(71) Applicant: Erika Rullman Lisman, Miami Beach, FL (US)

(72) Inventor: Erika Rullman Lisman, Miami Beach, FL (US)

( * ) Notice: Subject to any disclaimer, the term of this patent is extended or adjusted under 35 U.S.C. 154(b) by 0 days.

(21) Appl. No.: 19/015,280

(22) Filed: Jan. 9, 2025

(65) Prior Publication Data

US 2026/0191292 A1 Jul. 9, 2026

(51) Int. Cl.

| | |
|---|---|
| ***A43B 7/144*** | (2022.01) |
| ***A43B 7/1445*** | (2022.01) |
| ***A43B 7/145*** | (2022.01) |
| ***A43B 13/18*** | (2006.01) |
| ***A43B 13/40*** | (2006.01) |

(52) U.S. Cl.

CPC ..... *A43B 7/144* (2013.01); *A43B 7/1445* (2013.01); *A43B 7/145* (2013.01); *A43B 13/18* (2013.01); *A43B 13/40* (2013.01)

(58) Field of Classification Search

CPC ..... A43B 13/41; A43B 13/42; A43B 13/125; A43B 13/127; A43B 13/10; A43B 23/22; A43B 23/222; A43B 21/00; A43B 21/02; A43B 21/24

USPC ..... 36/34 B

See application file for complete search history.

(56) References Cited

U.S. PATENT DOCUMENTS

| | | | | | |
|---|---|---|---|---|---|
| 1,792,965 | A | * | 2/1931 | Burger | A43B 21/00 12/146 B |
| 2,255,941 | A | * | 9/1941 | Rule | A43B 21/00 D2/966 |
| 2,565,662 | A | * | 8/1951 | Mcmahon | A43B 13/40 36/19 R |
| 2,863,231 | A | * | 12/1958 | Jones | A43B 7/14 36/174 |
| 4,115,933 | A | * | 9/1978 | Chiaramonte, Jr. | A43B 3/24 36/137 |
| 4,446,633 | A | * | 5/1984 | Scheinhaus | A43B 7/24 D2/916 |
| 5,063,692 | A | * | 11/1991 | Suginaka | A43B 7/142 36/43 |

(Continued)

FOREIGN PATENT DOCUMENTS

| | | |
|---|---|---|
| AU | 2014286929 B2 | 2/2017 |
| KR | 20120022496 A | 3/2012 |
| WO | 2008113197 A2 | 9/2008 |

*Primary Examiner* — Ted Kavanaugh

(57) ABSTRACT

The ergonomic high heeled footwear is intended to provide users with a footwear design that addresses the common issues associated with traditional high heel wear, such as foot pain, forward foot slippage, excessive forefoot loading, metatarsalgia, neuromas, bunions, hammertoes, the risk of chronic injuries, and the risk of chronic injuries. To accomplish this, a unique combination of metatarsals indents, arch outdents, toe indents, and a specially designed heel indentation and heel structure, tailored to the natural contours of the foot, represents a breakthrough in ergonomics are applied to high heel design. Further, a layered insole layer made of different flexibilities having specific shapes and made of specific materials provide a combination of support and comfort that matches a variety of foot shapes and contours. An outer covering around the whole structure provides aesthetic appeal and more comfort.

15 Claims, 9 Drawing Sheets

(56) References Cited

U.S. PATENT DOCUMENTS

| | | | | |
|---|---|---|---|---|
| 8,256,142 | B2 * | 9/2012 | Igdari | A43B 7/1445 36/43 |
| 2004/0211086 | A1 * | 10/2004 | Dananberg | A43B 7/141 36/43 |
| 2006/0191166 | A1 | 8/2006 | Johnson et al. | |
| 2007/0151124 | A1 | 7/2007 | Chan | |
| 2009/0193683 | A1 * | 8/2009 | Igdari | A43B 7/142 36/43 |
| 2017/0079379 | A1 * | 3/2017 | Singh | A43B 7/1445 |
| 2017/0251749 | A1 * | 9/2017 | Hughes | A43B 7/1445 |
| 2025/0169572 | A1 * | 5/2025 | Rothermel | A43B 3/12 |

* cited by examiner

ERGONOMIC HIGH HEELED FOOTWEAR

FIELD OF THE INVENTION

The present invention relates generally to a footwear design. More specifically, the present invention is an ergonomic high heel midsole and insole construction that contours the natural curves of the human foot, moves pressure vectors away from the metatarsophalangeal (MTP) joint and redistributes these pressures towards other parts of the foot.

BACKGROUND OF THE INVENTION

Traditional high heels are known for their steep angles and flat, unergonomic surfaces, leading to pain and health issues for the wearer. Namely, concentrated pressure distribution towards a singular point, the MTP, is identified as the main source of fatigue and discomfort for high heel wearers. Recent studies show that shoes with flat heels (heel height=0 cm) push approximately 28% of body weight (BW) towards the forefoot and toe regions. This figure steadily increases as heel height increases and was more than double (up to 66% of body weight) loading towards the forefoot in shoes with very high heels (heel height=10 cm). The current market lacks high heels that effectively balance pressure distribution to other parts of the foot, taking some of the load off of the MTP, and especially that do so with designer aesthetic. Several podiatric ailments can be traced back to high heel usage. The following are a few.

Foot Pain and Deformities: High heels can lead to various foot problems including bunions, hammertoes, callouses, and overall foot pain. The pressure exerted on the ball of the foot and toes when wearing heels can be substantial, contributing to these conditions.

Metatarsalgia: This condition involves pain and inflammation in the ball of the foot. It's caused by displacement of the fat pad that cushions the metatarsal head (the knuckle joints of the toes), leading to walking on essentially skin and bones.

Neuromas: These are irritated nerve endings on the bottom of the feet, often becoming pinched due to pressure and leading to significant pain. This condition may require extensive treatment including physical therapy, medication, or surgery.

Tight Achilles Tendon: Continuous wearing of high heels can lead to a contracted, stiff Achilles tendon. This not only affects the feet but can also lead to other foot and ankle conditions like plantar fasciitis, tendonitis, and stress fractures.

Posture Dysfunction: High heels can alter the natural motion of feet, affecting the distribution of pressure on the bottom of the feet. This can lead to muscle imbalances in the legs, stress on the hip, curvature of the back, and even TMJ disorders (jaw pain) due to the altered posture and gait.

Ingrown Toenails: Tight shoes, often a characteristic of high heels, can cause swelling of the feet, leading to ingrown toenails that can become painful and infected.

Increased Pressure and Pain: Regular wear of high heels can lead to increased pressure at the ball of the foot, resulting in knee, hip, and back pain, as well as decreased flexibility and increased fatigue during activities like running.

Given these issues, the need for a high heel design that addresses ergonomic concerns and reduces health risks is evident. The present invention, with its unique design featuring metatarsals indents, metatarsals ridge, arch outdents and heel indents, aims to mitigate these problems by providing better support and weight distribution. This innovative approach could significantly improve the comfort and health of high heel wearers.

An objective of the present invention is to provide users with an innovative design in high heeled footwear, focusing on ergonomic comfort, improved weight distribution and nontraditional fabrication. More specifically, the present invention addresses the common discomfort and health issues associated with wearing traditional high heels.

SUMMARY OF INVENTION

The present invention is intended to provide users with high-heeled footwear having a novel ergonomic high heel midsole and insole design. In other words, an objective of the present invention is to provide users with an innovative high heeled footwear design, that focuses on ergonomic comfort, improved weight distribution and nontraditional fabrication. To accomplish this, the present invention comprises an insole made of different layers having specific shapes and made of specific materials. Further, the present invention comprises a plurality of indents and outdents that are placed strategically and ergonomically to address the common discomfort and health issues associated with wearing traditional high heels.

DETAILED DESCRIPTION OF THE INVENTION

Figure 1:
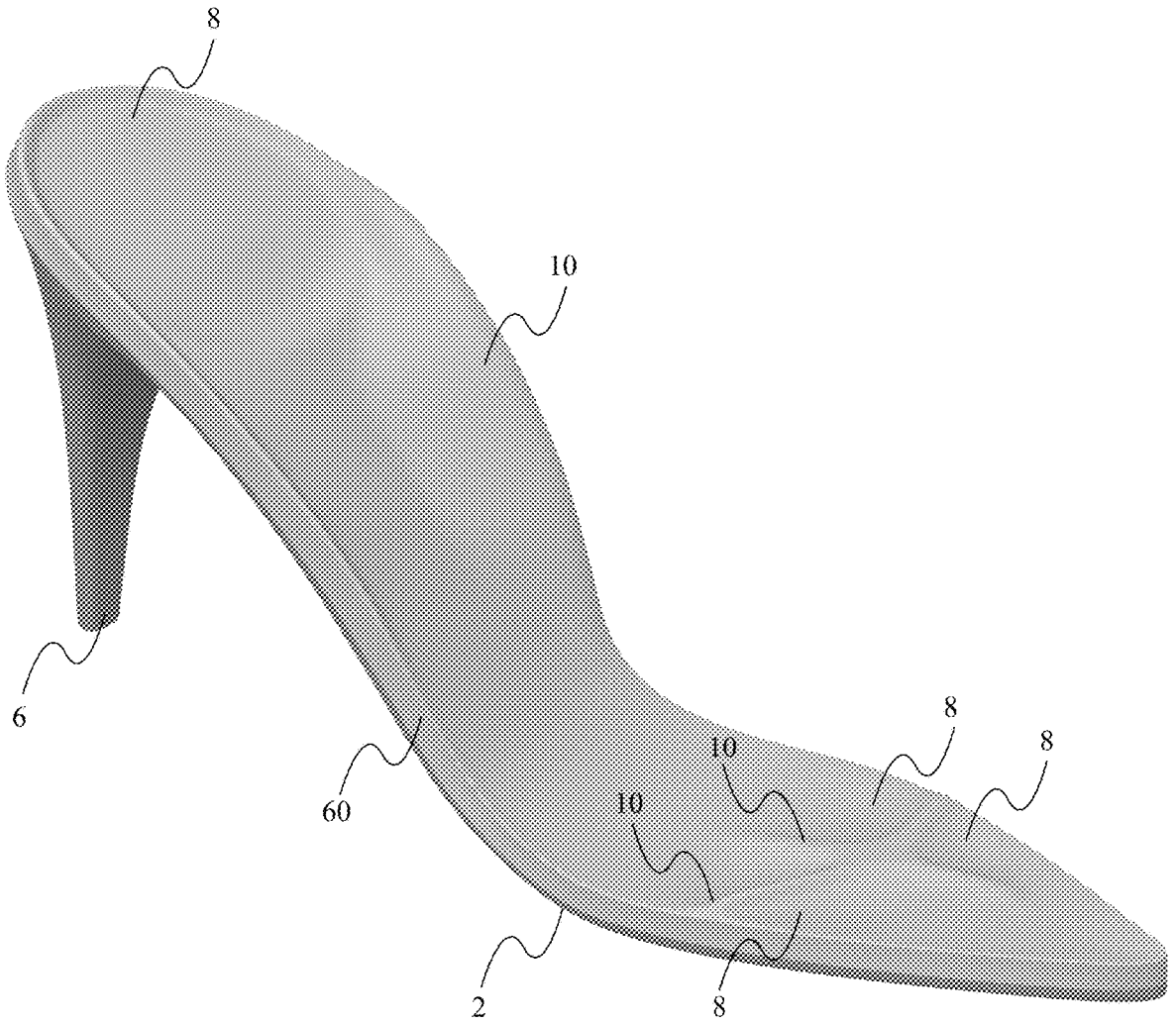
FIG. 1 is a top-front-left perspective view of the present invention.
Figure 2:
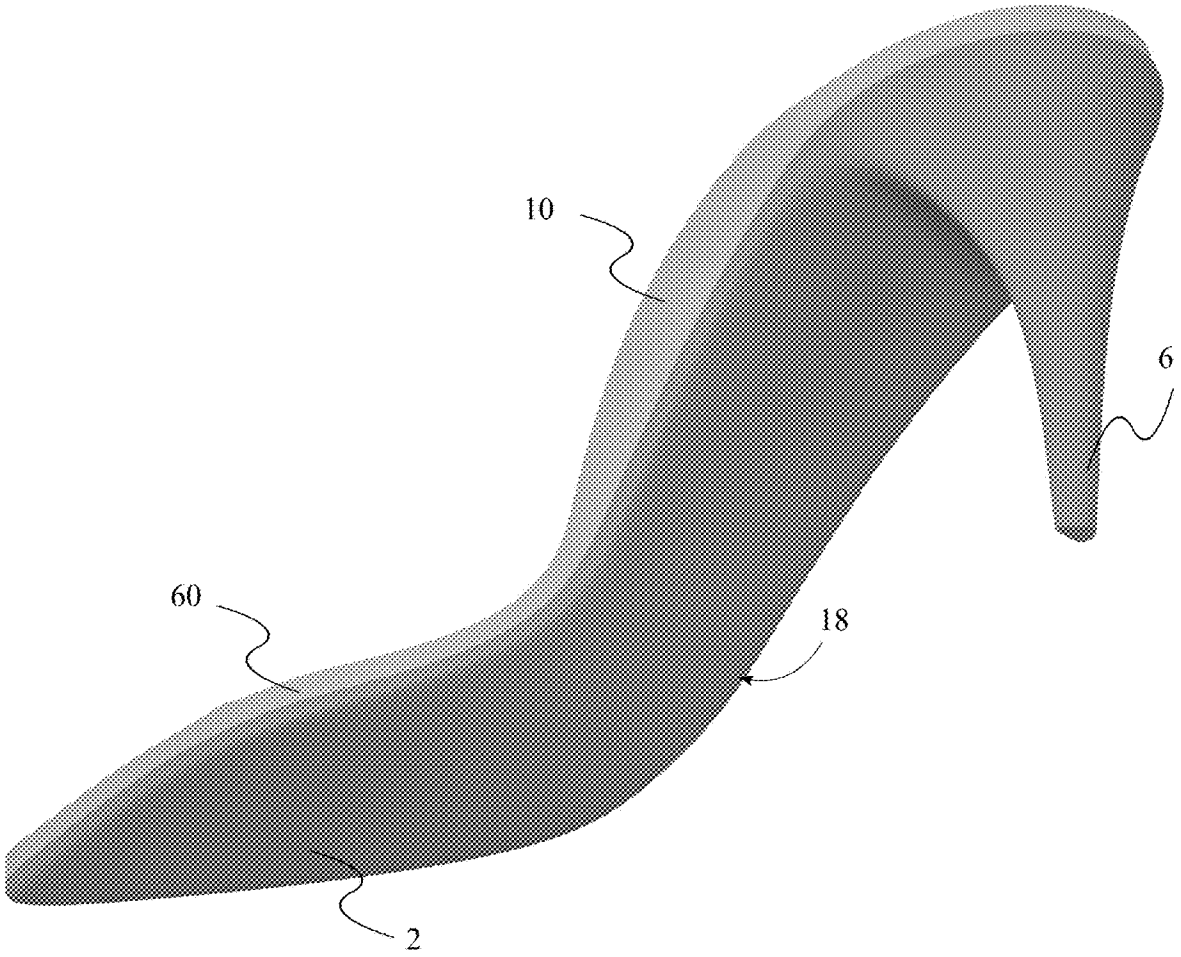
FIG. 2 is a rear perspective of the present invention.
Figure 3:
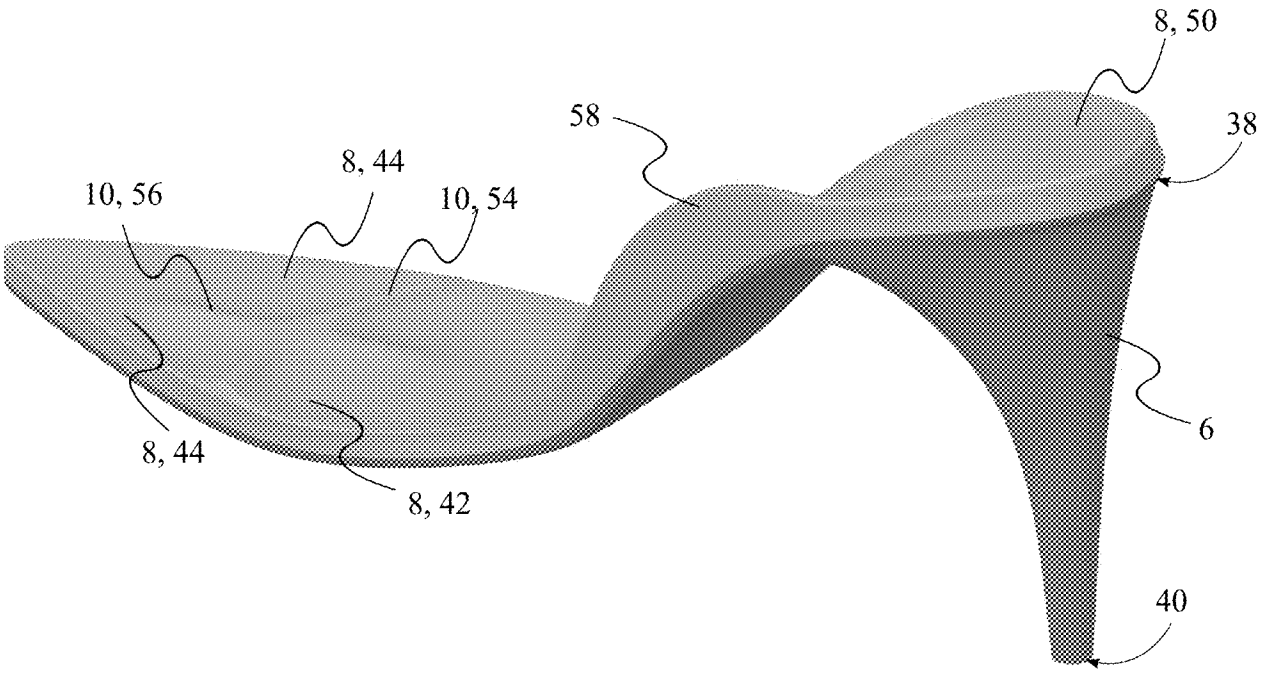
FIG. 3 is a top-rear-right perspective of the present invention.

All illustrations of the drawings are for the purpose of describing selected versions of the present invention and are not intended to limit the scope of the present invention.

In reference to FIG. 1 through FIG. 9, the present invention is a high-heeled footwear design.

The following description is in reference to FIG. 1 through FIG. 9. According to a preferred embodiment, the present invention comprises a footwear base 2, a footwear insole 4, a footwear heel 6, a plurality of indents 8, and a plurality of outdents 10. Preferably, the footwear base 2 is the bottommost sturdy layer of the footwear that provides support and stability for the footwear. To that end, any strong sturdy material that is known to one of ordinary skill in the art may be used as the footwear base 2. Further, the footwear insole 4 comprises a rigid insole layer 12 and a cushioning insole layer 14. The rigid insole layer 12 or the midsole is the layer that sits right on top of the footwear base 2. The rigid insole layer 12 may have metal shanks embedded into it. The choice of materials and construction methods for the present invention is also focused on ergonomic benefits. The use of cushioning materials in key areas like the ball of the foot and heel can further enhance comfort and reduce the impact on the feet and spine. Additionally, the use of flexible materials can aid in the natural movement of the foot, reducing the stiffness and discomfort often associated with high heels. Thus, the cushioning insole layer 14 provides the necessary comfort for the user's foot.

Figure 7:
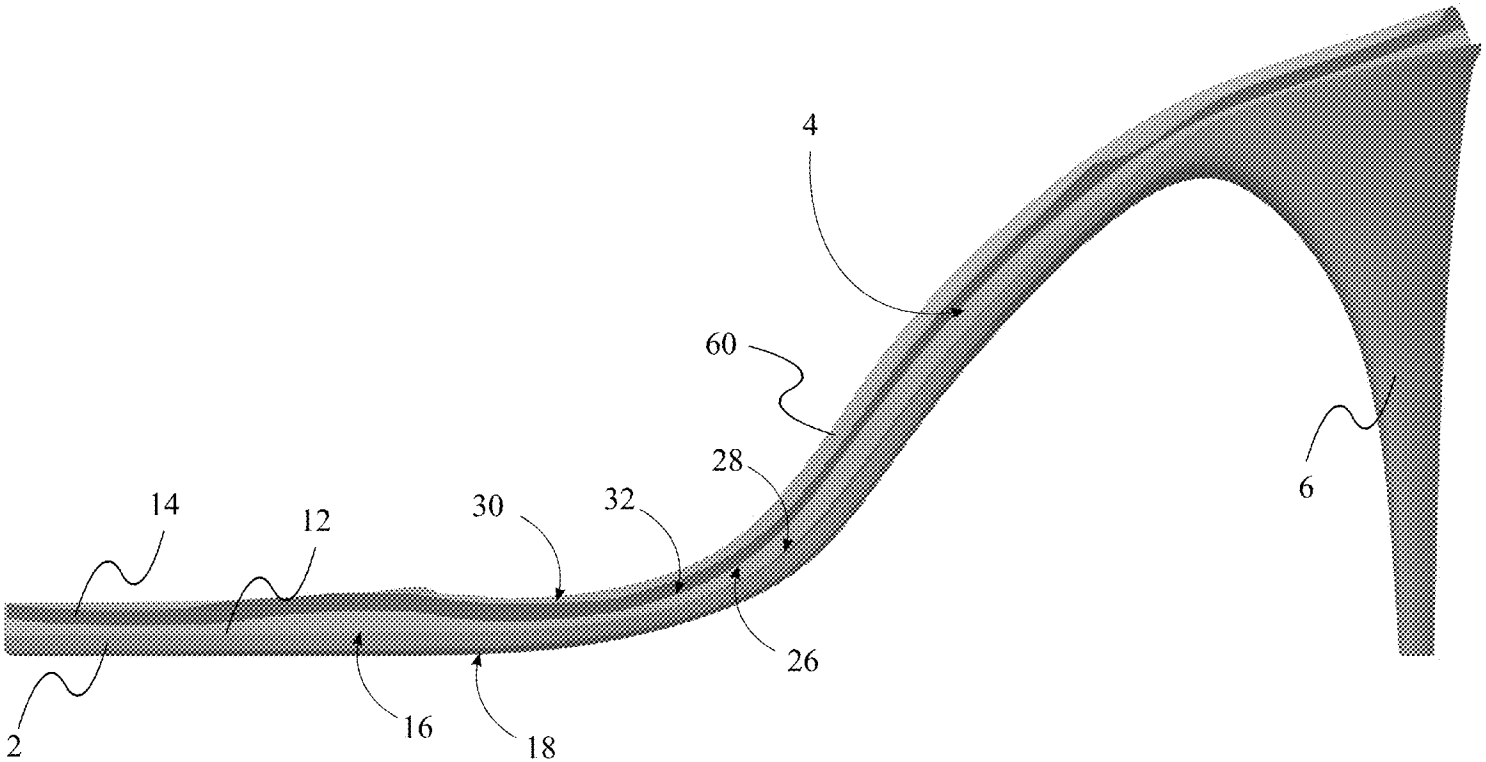
FIG. 7 is a sectional view taken along A-A' of FIG. 6.
Figure 8:
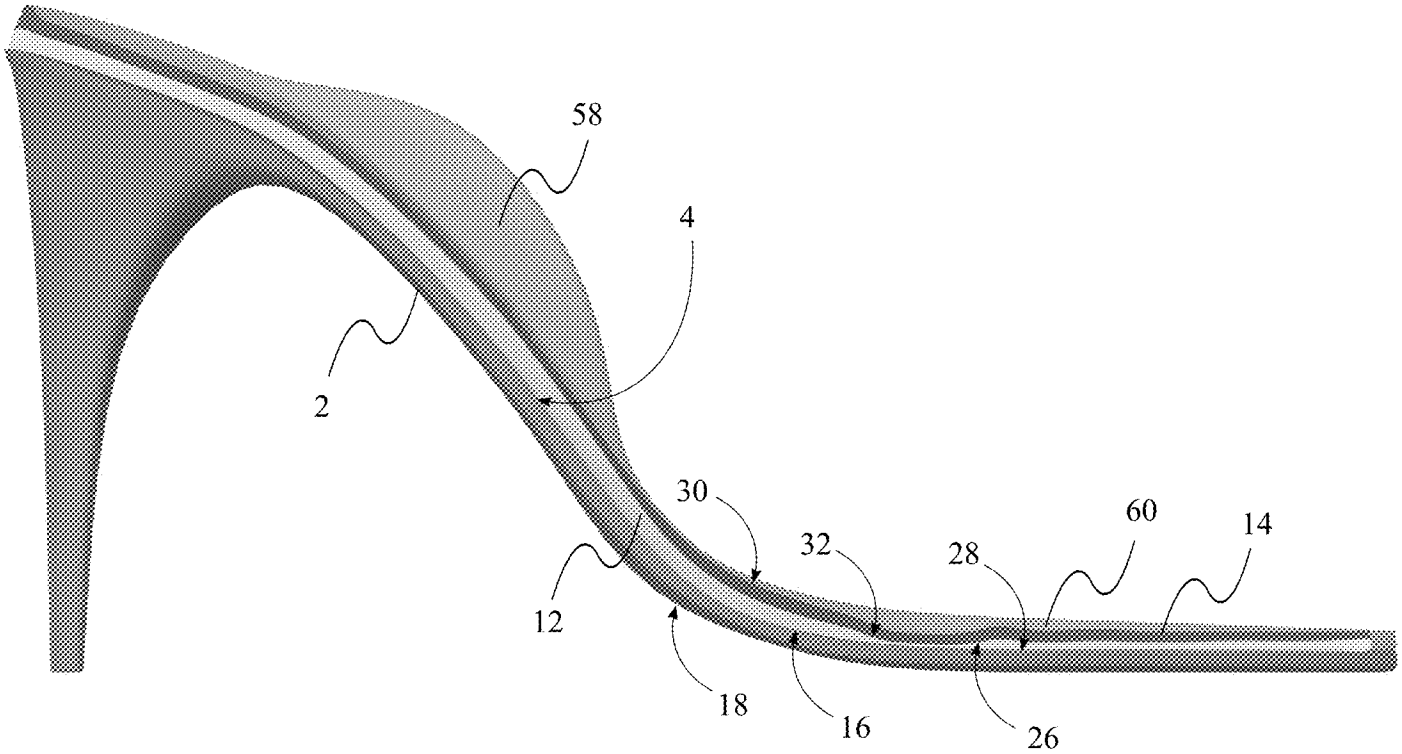
FIG. 8 is a sectional view taken along B-B' of FIG. 6.
Figure 9:
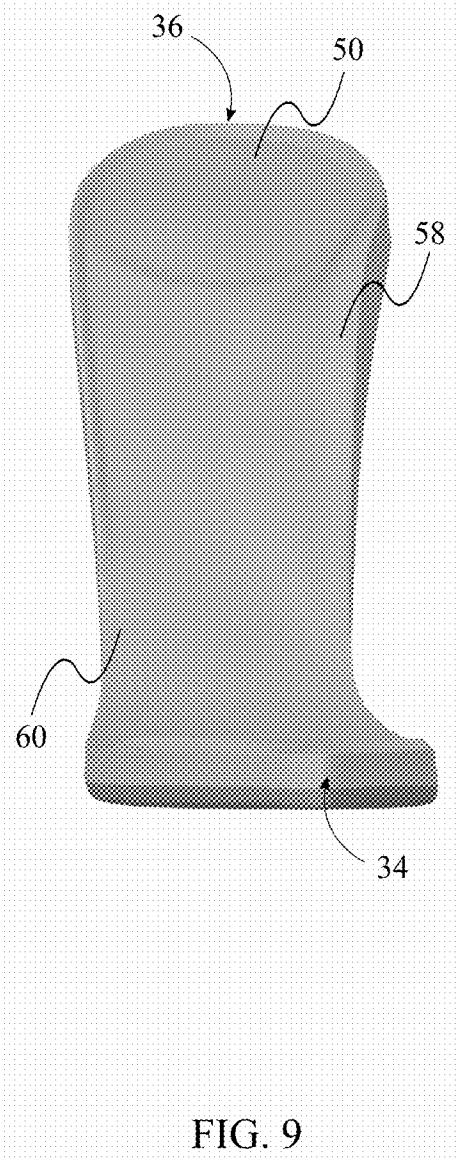
FIG. 9 is a front elevational view of the present invention.

In the preferred embodiment, the footwear base 2 comprises a first base surface 16 and a second base surface 18, wherein the first base surface 16 is positioned opposite to the second base surface 18 about the footwear base 2. In other words, the first base surface 16 constitutes a top surface of the footwear base 2, and the second base surface 18 constitutes a lower surface of the footwear base 2. As seen in FIG. 7 and FIG. 8, the footwear insole 4 is mounted onto and across the first base surface 16. Further, the rigid insole layer 12 is positioned in between the first base surface 16 and the cushioning insole layer 14. This is so that the cushioning insole layer 14 will be in contact with the user's foot providing comfort and less impact, whereas the rigid insole layer 12 provides the needed support without causing any impact on the users' natural foot shape. Furthermore, the footwear heel 6 is mounted onto the second base surface 18. Preferably, the footwear heel 6 is a high heel structure that is long and tapers towards the end. However, the footwear heel 6 can be of any size, shape, material, etc. that are known to one of ordinary skill in the art, as long as the intents of the present invention are not altered. The footwear heel 6 is structurally designed to provide stability and support to the entire shoe, ensuring durability and safety.

According to the preferred embodiment, the overall shape of the high heel midsole/insole in this invention is tailored to follow the natural contours of the foot. The ergonomic shape helps to cradle the foot snugly within the shoe, redistributing pressures away from the MTP (metatarsophalangeal) joint, while also preventing slipping and improving the fit and comfort of the footwear. This design reduces much of the unnatural strain on the feet, ankles, and legs that are typically associated with high heels. To that end, the plurality of indents 8 traverses into the footwear insole 4 from the cushioning insole layer 14, and the plurality of outdents 10 are mounted onto the cushioning insole layer 14, opposite to the footwear heel 6. In other words, the plurality of indents 8 and plurality of outdents 10 provide an ergonomic platform that addresses the common issues associated with traditional high heel foot wears.

A more detailed description of the present invention follows. As seen in FIG. 1 through FIG. 9, the present invention may comprise an outer covering 60. The outer covering 60 is the layer of fabric that covers the exposed portions of the footwear. In other words, the outer covering 60 encapsulates an upper cushioning surface 30 of the cushioning insole layer 14, a laterally-exposed portion of the footwear insole 4, a laterally-exposed portion of the footwear base 2, and the footwear heel 6. More specifically, the outer covering 60 is the layer of the footwear that is visible outside. Further, the outer shape or ergonomic design of the top layer of the footwear insole 4 or the cushioning layer is visible though the outer covering 60. To that end, the outer covering 60 is tensionably stretched to contour across the plurality of indents 8 and the plurality of outdents 10.

Figure 5:
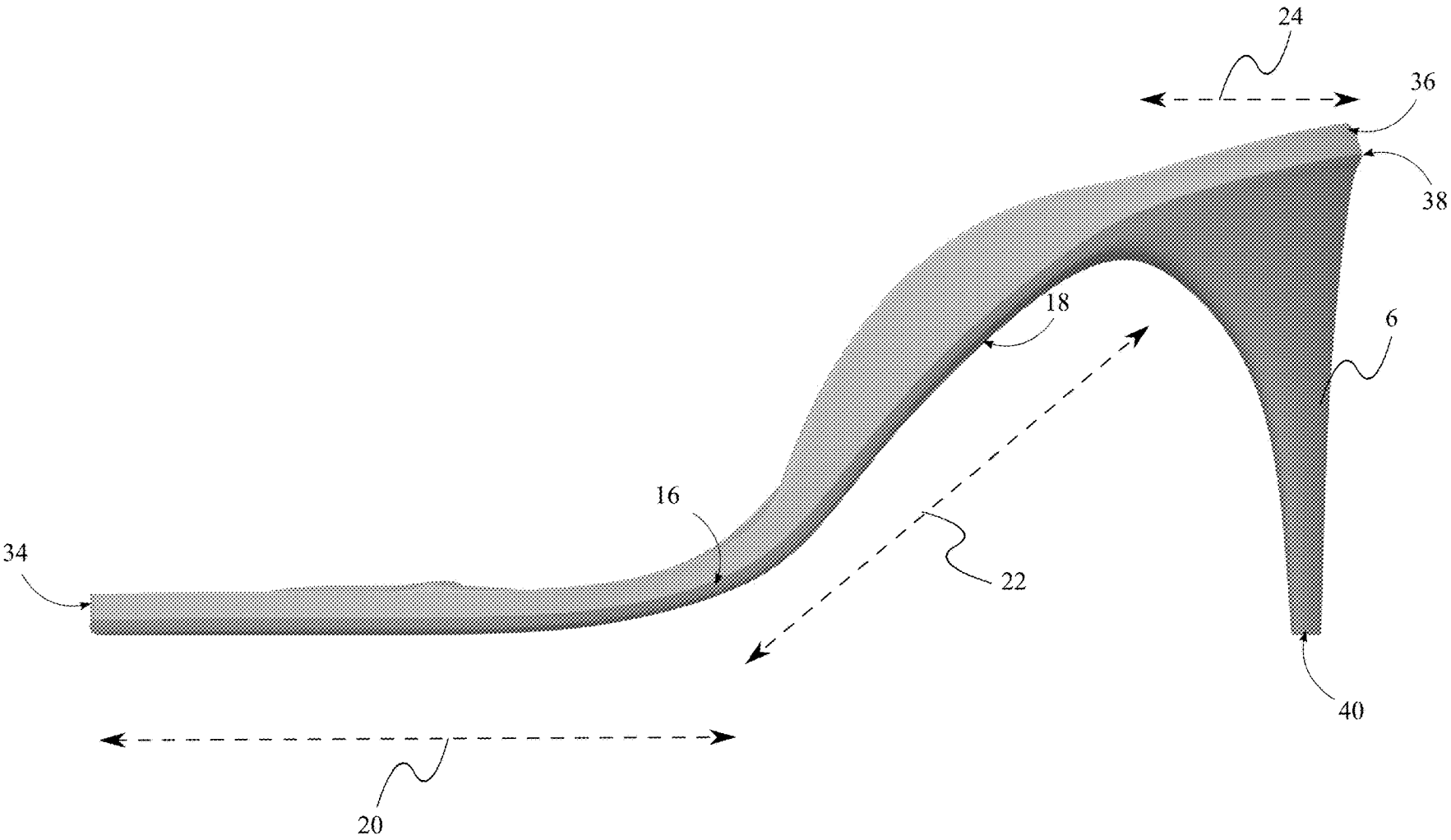
FIG. 5 is a right-side elevational view of the present invention.

Continuing with the preferred embodiment, and as seen in FIG. 5, the footwear base 2 further comprises a flat portion 20, an incline portion 22, and an elevated portion 24. Preferably, the incline portion 22 is positioned in between the flat portion 20 and the elevated portion 24. More specifically, the flat portion 20 extends into the incline portion 22 and the incline portion 22 extends into the elevated portion 24 seamlessly. Further, the footwear heel 6 is mounted onto the second base surface 18, adjacent to the elevated portion 24. In other words, the heel 6 of the footwear extends down from the footwear base 2 in the elevated portion 24.

In reference to FIG. 5, the footwear heel 6 may comprise a first heel end 38 and a second heel end 40. Preferably, the first heel end 38 is positioned opposite to the second heel along the footwear heel 6. More specifically, the first heel end 38 constitutes a top end of the footwear heel 6 and the second heel end 40 constitutes a lower end of the footwear heel 6, that touches the ground. Further, the footwear heel 6 tapers from the first heel end 38 towards the second heel end 40. This shape provide support while maintaining aesthetic appeal to the heel design. Furthermore, the first heel end 38 is connected onto the second base surface, adjacent to the elevated portion 24, and the second heel end 40 is positioned coplanar to the flat portion 20. In other words, the bottom end of the footwear heel 6 touches the ground along the same line as the flat portion 20 of the footwear base 2.

Continuing with the preferred embodiment, and as seen in FIG. 7 and FIG. 8 the cushioning insole layer 14 comprises an upper cushioning surface 30 and a lower cushioning surface 32, and the rigid insole layer 12 comprises an upper rigid surface 26 and a lower rigid surface 28. Preferably, the upper rigid surface 26 is positioned opposite to the lower rigid surface 28 across the rigid insole layer 12, and the upper cushioning surface 30 is positioned opposite to the lower cushioning surface 32 across the cushioning insole layer 14. More specifically, the upper cushioning surface 30 and the lower cushioning surface 32 constitutes a top surface and a bottom surface of the cushioning insole layer 14 respectively, and the upper rigid surface 26 and the lower rigid surface 28 constitutes a top surface and a bottom surface of the rigid insole layer 12 respectively. As seen in FIG. 7 and FIG. 8, the upper rigid surface 26 is superimposed across the lower cushioning surface 32, and the lower rigid surface 28 is superimposed across the first base surface 16. In other words, the upper rigid surface 26 is pressed against the lower cushioning surface 32, following the contours of the lower cushioning surface 32. Similarly, the lower rigid surface 28 is pressed against the first base surface 16, following the contours of the first base surface 16. Further, the plurality of indents 8 traverses through the upper cushioning surface 30, through the cushioning insole layer 14, through the lower cushioning surface 32, through the upper rigid surface 26, and into the rigid insole layer 12. In other words, the shape of the depressions and protrusions on the cushioning insole layer 14 extends till the bottom surface of the rigid insole layer 12. However, the lower rigid surface 28 has a plain surface to have a seamless joint with the footwear base 2. More specifically, the plurality of indents 8 is positioned offset from the lower rigid surface 28.

In order to provide a high heel design that addresses ergonomic concerns and reduces health risks, the present invention includes a unique design featuring metatarsals indents, metatarsals ridge, arch outdents and heel indents, that aims to mitigate usual support and foot shape related problems by providing better support and weight distribution. To accomplish this, the plurality of indents 8 may comprise a plurality of metatarsals indents 42, a plurality of toe indents 44, and a heel indent 50. The plurality of metatarsals indents 42 are meticulously designed to cradle the metatarsal bones of the foot. The design ensures that the weight of the wearer is distributed more evenly across the forefoot, rather than concentrated on the MTP. A 'memory foam' type material or the cushioning insole layer 14 properly cradle the ball of each foot, regardless of size, from smaller to larger anatomy. This feature is particularly beneficial in reducing the risk of metatarsalgia, a common issue in high heel wearers, where the lack of support in traditional heels leads to pain and inflammation in the ball of the foot. The plurality of toe indents 44 provides a subtle but effective ergonomic benefit for the toes. They offer a more natural resting position for the toes, reducing the cramping and crowding that typically occurs in high heels. This feature also helps in minimizing the risk of developing ingrown toenails, a condition often exacerbated by the narrow toe boxes of conventional high heels. The heel indent 50 is designed to mirror the natural contour of the heel, providing a snug and comfortable fit. This design minimizes the risk of the heel slipping out of the shoe, a common problem in high heels that can lead to instability and ankle sprains.

Figure 4:
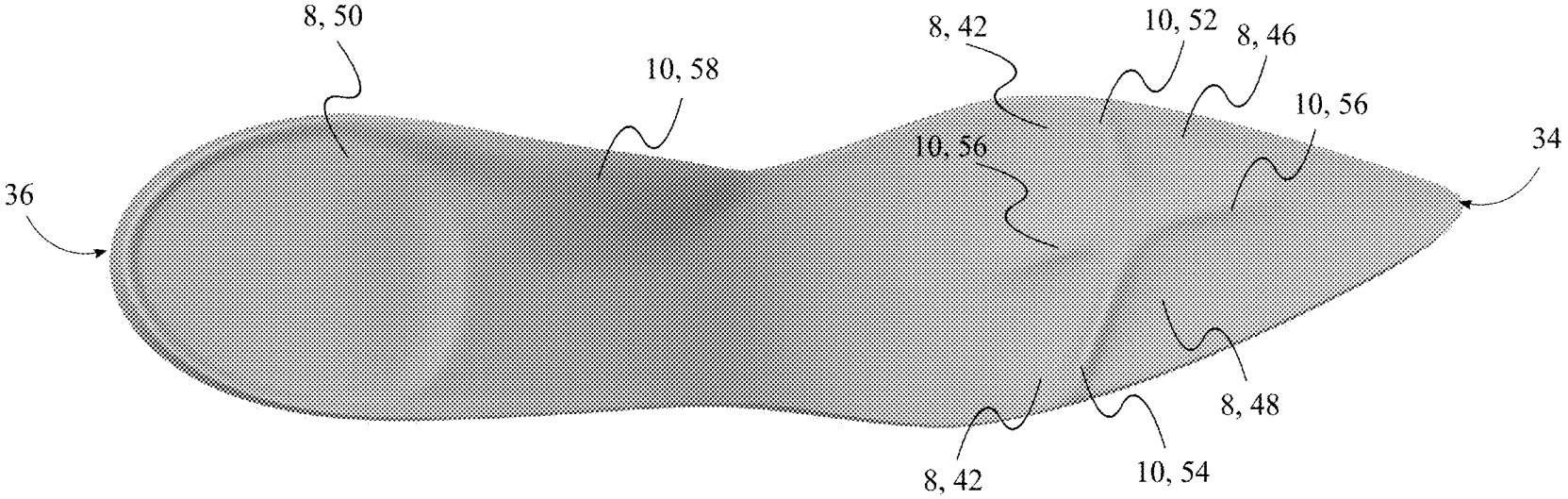
FIG. 4 is a top plan view of the present invention in horizontal orientation.

As seen in FIG. 4 and FIG. 5, the footwear insole 4 may comprise a toe insole end 34 and a heel insole end 36, wherein the heel insole end 36 is positioned opposite to the toe insole end 34 along the footwear insole 4. In other words, the heel insole end 36 constitutes a rear end of the footwear and the toe insole end 34 constitutes a front end of the footwear. As seen in FIG. 4, the plurality of metatarsal indents and the plurality of toe indents 44 are positioned adjacent to the toe insole end 34. Further, the plurality of metatarsals indents 42 is positioned offset from the plurality of toe indents 44. Furthermore, the heel indent 50 is positioned adjacent to the heel insole end 36. All these indent features are provided within the cushioning insole layer 14 in order to cradle the heel and other arches of each foot, regardless of size, from smaller to larger anatomy.

Figure 6:
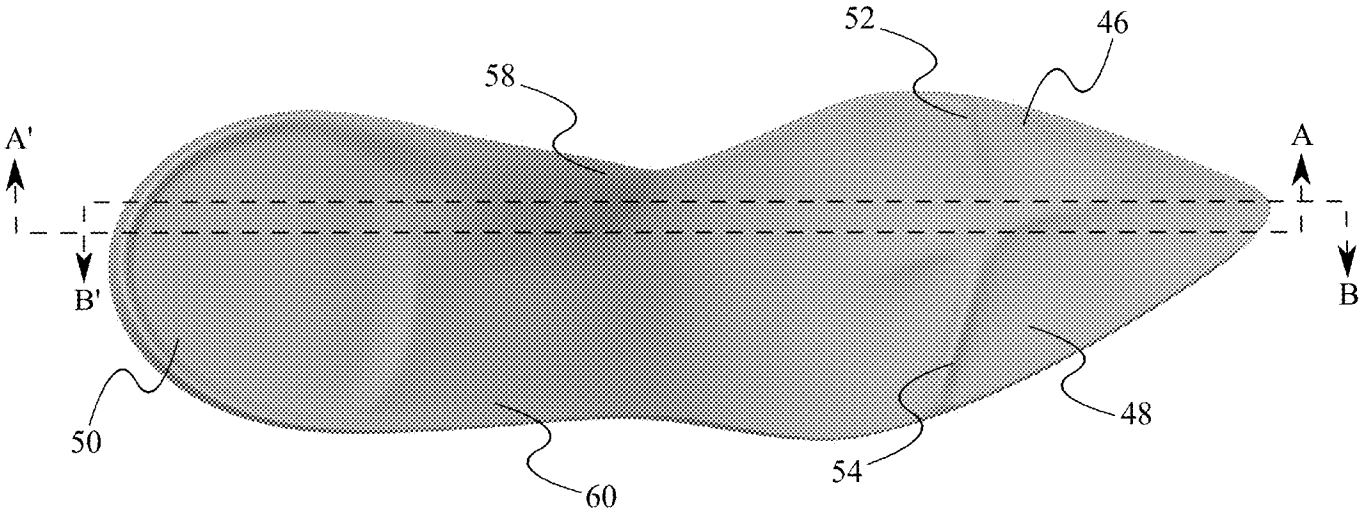
FIG. 6 is a top plan view of the present invention in vertical orientation.

Continuing with the preferred embodiment, the plurality of outdents 10 comprises a medial metatarsal outdent 52, a lateral metatarsal outdent 54, a middle metatarsal outdent 56, and an arch outdent 58. The medial metatarsal outdent 52 and the lateral metatarsal outdent 54 act as barriers to prevent the foot from sliding too far forward in the shoe. This is crucial in high heels, as the elevated heel position tends to push the foot forward, placing excessive pressure on the toes and away from the mid and rear foot regions. By stopping this forward motion, the metatarsals outdent stopper aids in ensuring proper fit of the shoe and preventing conditions like hammer toes and bunions, common in high heel wearers due to cramped toe spaces in conventional high heels. As seen in FIG. 6, the plurality of toe indents 44 may comprise a big-toe indent 46 and a little-toes indent 48. Preferably, the medial metatarsal outdent 52 is positioned in between the big-toe indent 46 and the plurality of metatarsal indents. Further, the lateral metatarsal outdent 54 is positioned in between the little-toes indent 48 and the plurality of metatarsal indents 42. In the preferred embodiment, the middle metatarsal outdent 56 serves to separate the metatarsal area from left and right. This design element not only offers additional support and balance but also encourages proper alignment of the foot within the shoe. It aids in maintaining the natural arch of the foot, countering the flattening effect seen in traditional high heels. Accordingly, the middle metatarsal outdent 56 is positioned in between the medial metatarsal outdent 52 and the lateral metatarsal outdent 54.

The arch outdent 58 is a critical feature for supporting the natural arch of the foot. Traditional high heels often lead to a flattening of the arch, leading to conditions like plantar fasciitis. The arch outdent 58 in this design provides a supportive rest for the arch, reducing strain on the plantar fascia. This arch support also takes what would normally be a straight vector that concentrates between 28% and 66% (BW) pressure directly towards the MTP (depending on heel height) and replaces that straight vector with a curvilinear geometry that dissipate the load along the curve, thus reducing the overall load reaching the MTP. Like the metatarsal indents 42, the arch outdent 58 design ensures that the weight of the wearer is distributed more evenly across the foot, rather than concentrated on the toes and ball of the foot. Thus, the arch outdent 58 is positioned in between the plurality of metatarsals indents 42, and the heel indent 50.

Continuing with the preferred embodiment, the footwear insole 4 is coextensive with the footwear base 2. In other words, peripheral ends of the footwear insole 4 sits flush with the perimetrical ends of the footwear base 2, leaving no gaps in between. This ensures complete support and stability for the overall design of the footwear.

In conclusion, the present invention of an ergonomic high heel platform marks a significant advancement in the realm of footwear design, particularly in high heels. By innovatively addressing the common issues associated with traditional high heel wear, such as foot pain, posture, forward foot slippage, excessive forefoot loading, metatarsalgia, neuromas, bunions, hammertoes, and the risk of chronic injuries, this invention offers a transformative solution for wearers who seek both elegance and comfort in their footwear.

The unique combination of metatarsals indents, arch outdents, toe indents, and a specially designed heel indentation and heel structure, tailored to the natural contours of the foot, represents a breakthrough in ergonomics applied to high heel design. This invention is not only a testament to the fusion of style and comfort but also serves as a proactive approach to mitigating the health risks often associated with prolonged high heel use.

Furthermore, this invention has the potential to redefine the standard for high heel manufacturing, setting a new benchmark for ergonomic design in the footwear industry. It addresses a long-standing gap in the market for high heels that prioritize the wearer's health and comfort without compromising on aesthetic appeal.

By offering a more anatomically friendly alternative to traditional high heels, this invention stands as a beacon of innovation in footwear design. It holds promise not only for immediate user benefits but also for contributing to a broader shift in how high heels are perceived and utilized in fashion, potentially influencing future design trends towards more health-conscious and ergonomically sound choices.

In essence, this ergonomic high heel platform is not just a novel product, it represents a paradigm shift in the approach to footwear design, blending the allure of high heels with the practicality and necessity of ergonomic health considerations.

Although the invention has been explained in relation to its preferred embodiment, it is to be understood that many other possible modifications and variations can be made without departing from the spirit and scope of the invention as hereinafter claimed.

What is claimed is:

1. An ergonomic high heel footwear comprising:

a footwear base;

a footwear insole;

a footwear heel;

a plurality of indents;

a plurality of outdents;

an outer covering;

the footwear insole comprising a rigid insole layer and a cushioning insole layer;

the footwear base comprising a first base surface and a second base surface;

the first base surface being positioned opposite to the second base surface about the footwear base;

the footwear insole being mounted onto and across the first base surface;

the footwear heel being mounted onto the second base surface;

the rigid insole layer being positioned in between the first base surface and the cushioning insole layer;

the plurality of indents traversing into the footwear insole from the cushioning insole layer;

the plurality of outdents being mounted onto the cushioning insole layer, opposite to the footwear heel; and the outer covering encapsulating an upper cushioning surface of the cushioning insole layer, a laterally-exposed portion of the footwear insole, a laterally-exposed portion of the footwear base, and the footwear heel.

2. The ergonomic high heel footwear of claim 1, wherein the outer covering is tensionably stretched to contour across the plurality of indents and the plurality of outdents.

3. The ergonomic high heel footwear of claim 1 further comprising:

the footwear base further comprising a flat portion, an incline portion, and an elevated portion;

the incline portion being positioned in between the flat portion and the elevated portion; and the footwear heel being mounted onto the second base surface, adjacent to the elevated portion.

4. The ergonomic high heel footwear of claim 3 further comprising:

the footwear heel comprising a first heel end and a second heel end;

the first heel end being positioned opposite to the second heel along the footwear heel;

the footwear heel tapering from the first heel end towards the second heel end;

the first heel end being connected onto the second base surface, adjacent to the elevated portion; and the second heel end being positioned coplanar to the flat portion.

5. The ergonomic high heel footwear of claim 1 further comprising:

the cushioning insole layer comprising an upper cushioning surface and a lower cushioning surface;

the rigid insole layer comprising an upper rigid surface and a lower rigid surface;

the upper rigid surface being positioned opposite to the lower rigid surface across the rigid insole layer;

the upper cushioning surface being positioned opposite to the lower cushioning surface across the cushioning insole layer;

the upper rigid surface being superimposed across the lower cushioning surface;

the lower rigid surface being superimposed across the first base surface;

the plurality of indents traversing through the upper cushioning surface, through the cushioning insole layer, through the lower cushioning surface, through the upper rigid surface, and into the rigid insole layer; and the plurality of indents being positioned offset from the lower rigid surface.

6. The ergonomic high heel footwear of claim 1 further comprising:

the plurality of indents comprises a plurality of metatarsals indents, a plurality of toe indents, and a heel indent;

the footwear insole comprising a toe insole end and a heel insole end;

the heel insole end being positioned opposite to the toe insole end along the footwear insole;

the plurality of metatarsal indents and the plurality of toe indents being positioned adjacent to the toe insole end;

the plurality of metatarsals indents being offset from the plurality of toe indents; and the heel indent being positioned adjacent to the heel insole end.

7. The ergonomic high heel footwear of claim 6 comprising:

the plurality of outdents comprising a medial metatarsal outdent, a lateral metatarsal outdent, a middle metatarsal outdent, and an arch outdent;

the plurality of toe indents comprising a big-toe indent and a little-toes indent;

the medial metatarsal outdent being positioned in between the big-toe indent and the plurality of metatarsal indents;

the lateral metatarsal indents being positioned in between the little-toes indent and the plurality of metatarsal indents;

the middle metatarsal outdent being positioned in between the medial metatarsal outdent and the lateral metatarsal outdent; and the arch outdent being positioned in between the plurality of metatarsals indents and the heel indentation.

8. The ergonomic high heel footwear of claim 1, wherein the footwear insole is coextensive with the footwear base.

9. An ergonomic high heel footwear comprising:

a footwear base;

a footwear insole;

a footwear heel;

a plurality of indents;

a plurality of outdents;

an outer covering;

the footwear insole comprising a rigid insole layer and a cushioning insole layer;

the footwear base comprising a first base surface and a second base surface;

the first base surface being positioned opposite to the second base surface about the footwear base;

the footwear insole being mounted onto and across the first base surface;

the footwear heel being mounted onto the second base surface;

the rigid insole layer being positioned in between the first base surface and the cushioning insole layer;

the plurality of indents traversing into the footwear insole from the cushioning insole layer;

the plurality of outdents being mounted onto the cushioning insole layer, opposite to the footwear heel;

the outer covering encapsulating an upper cushioning surface of the cushioning insole layer, a laterally-exposed portion of the footwear insole, a laterally-exposed portion of the footwear base, and the footwear heel; and the outer covering being tensionably stretched to contour across the plurality of indents and the plurality of outdents.

10. The ergonomic high heel footwear of claim 9 further comprising:

the footwear base further comprising a flat portion, an incline portion, and an elevated portion;

the incline portion being positioned in between the flat portion and the elevated portion; and the footwear heel being mounted onto the second base surface, adjacent to the elevated portion.

11. The ergonomic high heel footwear of claim 10 further comprising:

the footwear heel comprising a first heel end and a second heel end;

the first heel end being positioned opposite to the second heel along the footwear heel;

the footwear heel tapering from the first heel end towards the second heel end;

the first heel end being connected onto the second base surface, adjacent to the elevated portion; and the second heel end being positioned coplanar to the flat portion.

12. The ergonomic high heel footwear of claim 9 further comprising:

the cushioning insole layer comprising an upper cushioning surface and a lower cushioning surface;

the rigid insole layer comprising an upper rigid surface and a lower rigid surface;

the upper rigid surface being positioned opposite to the lower rigid surface across the rigid insole layer;

the upper cushioning surface being positioned opposite to the lower cushioning surface across the cushioning insole layer;

the upper rigid surface being superimposed across the lower cushioning surface;

the lower rigid surface being superimposed across the first base surface;

the plurality of indents traversing through the upper cushioning surface, through the cushioning insole layer, through the lower cushioning surface, through the upper rigid surface, and into the rigid insole layer; and the plurality of indents being positioned offset from the lower rigid surface.

13. The ergonomic high heel footwear of claim 9 further comprising:

the plurality of indents comprises a plurality of metatarsals indents, a plurality of toe indents, and a heel indent;

the footwear insole comprising a toe insole end and a heel insole end;

the heel insole end being positioned opposite to the toe insole end along the footwear insole;

the plurality of metatarsal indents and the plurality of toe indents being positioned adjacent to the toe insole end;

the plurality of metatarsals indents being offset from the plurality of toe indents; and the heel indent being positioned adjacent to the heel insole end.

14. The ergonomic high heel footwear of claim 13 comprising:

the plurality of outdents comprising a medial metatarsal outdent, a lateral metatarsal outdent, a middle metatarsal outdent, and an arch outdent;

the plurality of toe indents comprising a big-toe indent and a little-toes indent;

the medial metatarsal outdent being positioned in between the big-toe indent and the plurality of metatarsal indents;

the lateral metatarsal indents being positioned in between the little-toes indent and the plurality of metatarsal indents;

the middle metatarsal outdent being positioned in between the medial metatarsal outdent and the lateral metatarsal outdent; and the arch outdent being positioned in between the plurality of metatarsals indents and the heel indentation.

15. The ergonomic high heel footwear of claim 9, wherein the footwear insole is coextensive with the footwear base.

* * * * *